US005819695A

United States Patent [19]

Kim

[11] Patent Number: 5,819,695

[45] Date of Patent: Oct. 13, 1998

[54] CUT-OFF DEVICE FOR ENGINE STARTING SYSTEMS

[76] Inventor: Youngshin Kim, Jukong Apartment 50-208, 660-12, Kaepo-dong, Kangnam-ku, Seoul, Rep. of Korea

[21] Appl. No.: 859,786

[22] Filed: May 19, 1997

[30] Foreign Application Priority Data

Jun. 7, 1996 [KR] Rep. of Korea ..... 1996 15029

[51] Int. Cl.[6] ..... F02N 11/08

[52] U.S. Cl. ..... 123/179.3; 290/37 A

[58] Field of Search ..... 123/179.3; 290/37 A, 290/38 R, 38 C, 38 D

[56] References Cited

U.S. PATENT DOCUMENTS 2,266,644 12/1941 Kuhn ..... 290/38 R
3,163,769 12/1964 Keuchen et al. ..... 290/37 A
3,681,658 8/1972 Naoi et al. ..... 290/37 A
4,490,620 12/1984 Hansen ..... 123/179.3

*Primary Examiner*—Andrew M. Dolinar
*Attorney, Agent, or Firm*—Darby & Darby

[57] ABSTRACT

A cut-off device for engine starting systems is disclosed. The cut-off device has a cut-off relay unit and prevents electric current of a storage battery from being applied to the magnetic switch of an activated starter motor, thus positively preventing the activated starter motor from being restarted carelessly. The device has a movable terminal, which normally connects the keybox assembly to an ST-terminal of the magnetic switch thereby closing a circuit for the starter motor but selectively separates the keybox assembly from the ST-terminal thereby opening the circuit for the starter motor after the motor is activated. In addition, an alarm means is provided on the cut-off relay unit. The cut-off device allows both the engine and the starter motor to be effectively used without being damaged within their expected life spans.

4 Claims, 3 Drawing Sheets

CUT-OFF DEVICE FOR ENGINE STARTING SYSTEMS

BACKGROUND OF THE INVENTION

1. Field of the Invention

The present invention relates, in general, to a protection means for engine starting systems and, more particularly, to a cut-off device for such engine starting systems, with a cut-off relay unit of the device being connected to the motor drive circuit of an engine starting system and adapted for positively preventing an activated starter motor of the system from being restarted carelessly thus allowing both an engine and the starter motor to be effectively used without being damaged within their expected life spans.

2. Description of the Prior Art

As well known to those skilled in the art, internal combustion engines for automobiles cannot self-start so that the crank shafts in the engines have to be rotated by external force in order to start the engines. In this case, the crank shaft in an engine has to be rotated at a speed of not less than a reference speed prior to starting the engine. The external force, used for rotating the crank shaft and starting the engine, is generated by a starting system, which comprises a starter motor, a storage battery and a switching means.

In order to start an engine with such a starting system, the switching means is switched on and causes the electric current of the battery to be applied to the starter motor thus turning on the motor. The starter motor in the above state rotates the crank shaft of the engine thereby starting the engine. Once the engine is started by the starter motor, the engine repeatedly performs an operating cycle, comprising injection, compression, explosion and exhaust strokes, thus running.

FIG. 1 is a circuit diagram of a typical engine starting system. As shown in FIG. 1, the engine starting system comprises a charger unit 100, a starter motor unit 200, a storage battery 300 and a keybox assembly 40.

In the above engine starting system, the battery 300 is connected to the first-stage terminal of the keybox assembly 40. The charger unit 10 includes an alarm bulb 20 and a generator 10. The alarm bulb 20, which is installed on the dashboard of a vehicle, is connected to the second-stage terminal of the keybox assembly 40 so that when the second-stage terminal of the keybox assembly 40 is activated, electric current of the battery 300 passes through both the keybox assembly 40 and the alarm bulb 20 prior to being applied to the L-terminal 12 of the generator 10. The L-terminal 12 of the generator 10 is grounded through a rotor coil. The generator 10 also includes a B-terminal 14, which is connected to the battery 300.

Meanwhile, the starter motor unit 200 includes a starter motor 210, which is grounded to the car body. The motor unit 200 also includes a magnetic switch 50 having three terminals: an ST-terminal 52, a B-terminal 54 and an F-terminal 56.

The above engine starting system is operated as follows.

In order to start the engine, a driver inserts a key into the key hole of the keybox assembly 40, which is provided on the steering column, and primarily rotates the key to the second-stage terminal where the driver has a feeling in that the key is slightly resting against a spring-biased device. In the above second-stage terminal, the electric current of the battery 300 passes through both the keybox assembly 40 and the alarm bulb 20 prior to being applied to the grounded L-terminal 12 of the generator 10. Therefore, the alarm bulb 20 is turned on.

When the key in the second-stage terminal is further rotated in the same direction thus reaching the third-stage terminal of the keybox assembly 40, the electric current of the battery 300 is applied to the ST-terminal 52 of the magnetic switch 50 through the keybox assembly 40. In this case, the B-terminal 54 of the magnetic switch 50 is brought into intercontact with the F-terminal 56 of the switch 50 through an electromagnet (not shown) so that the starter motor 210 generates a large torque in a short time and starts the engine. However, the above starting system is problematic in that the activated starter motor 210 may be restarted carelessly by, for example, an unskilled driver. Such a careless restarting of the activated starter motor 210 generates noises offensive to the ear and causes an excessive abrasion of the motor 210 thus shortening the expected life span of the motor 210.

When the activated starter motor 210 is restarted carelessly as described above, the elements of the engine starting system may break down, forcing the owner to purchase new ones at excessive costs while wasting time.

SUMMARY OF THE INVENTION

Accordingly, the present invention has been made keeping in mind the above problems occurring in the prior art, and an object of the present invention is to provide a cut-off device for engine starting systems, which is provided with both a cut-off relay unit and an alarm unit on a motor drive circuit for preventing electric current of a storage battery from being applied to the magnetic switch of an activated starter motor thus positively preventing the activated starter motor from being restarted carelessly.

In order to accomplish the above object, the present invention provides a cut-off device for engine starting systems individually having an alarm bulb, a generator, a storage battery, a magnetic switch, a starter motor and a keybox assembly, comprising: a cut-off relay unit connected to both an L-terminal of the generator and the alarm bulb in parallel and adapted for preventing electric current of the battery from being applied to the starter motor after the motor is activated, the cut-off relay unit including: a movable terminal normally connecting the keybox assembly to an ST-terminal of the magnetic switch thereby closing a circuit for the starter motor but selectively separating the keybox assembly from the ST-terminal thereby opening the circuit for the starter motor after the motor is activated; a desired voltage control resistor; and a relay adapted for controlling the movable terminal in cooperation with the resistor, thus selectively opening the circuit for the starter motor when a high voltage is generated from the L-terminal of the generator after the motor is activated.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
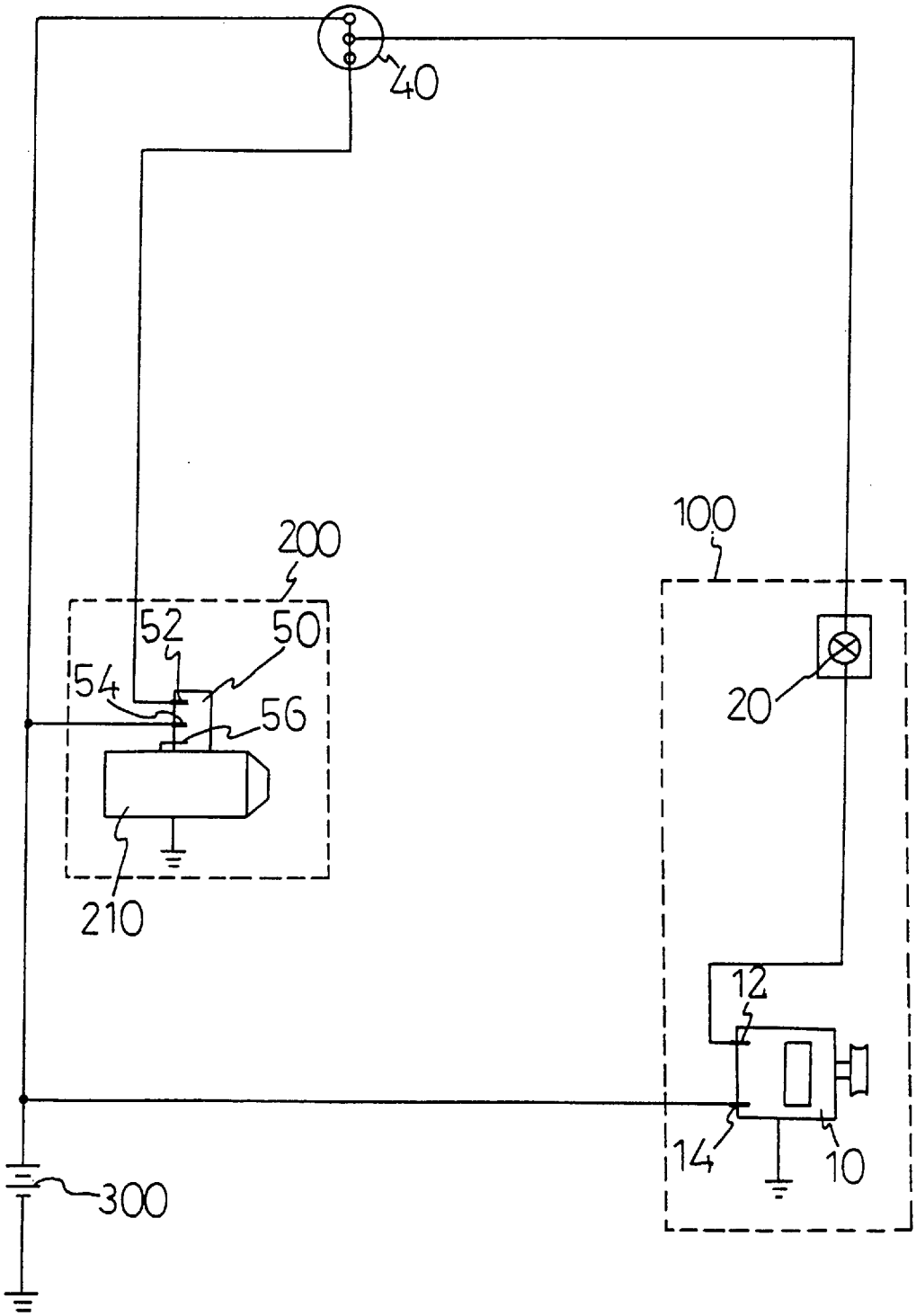
FIG. 1 PRIOR ART
FIG. 1 is a circuit diagram of a typical engine starting system.
Figure 2:
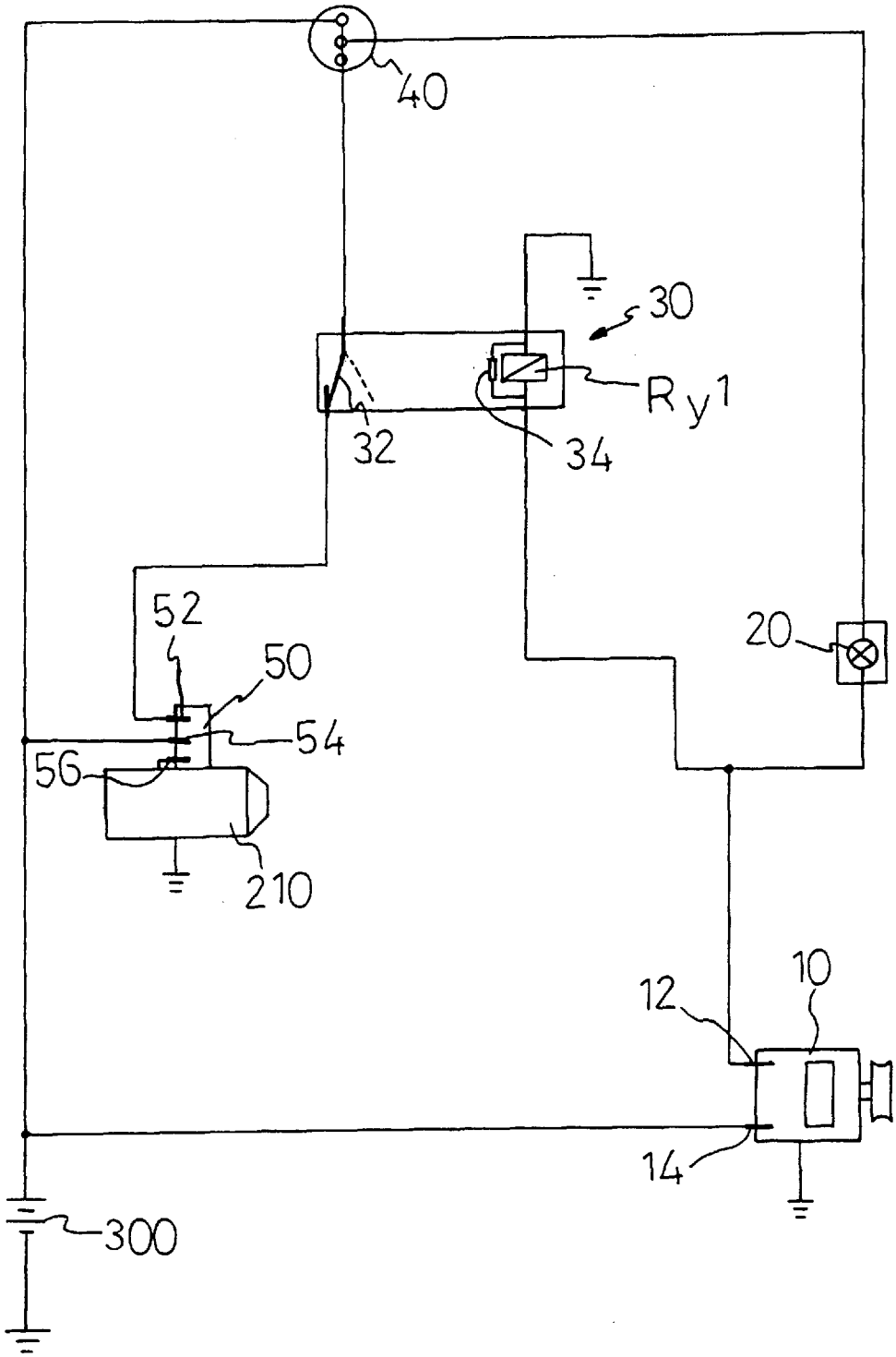
FIG. 2 is a circuit diagram of an engine starting system provided with a cut-off device according to the primary embodiment of the present invention.

FIG. 2 is a circuit diagram of an engine starting system provided with a cut-off device according to the primary embodiment of this invention.

As shown in FIG. 2, the engine starting system of this invention comprises a charger unit, a starter motor unit, a storage battery 300 and a keybox assembly 40.

In the above engine starting system, the battery 300 is connected to the first-stage terminal of the keybox assembly 40. The charger unit includes an alarm bulb 20 and a generator 10. The alarm bulb 20 is connected to the second-stage terminal of the keybox assembly 40 so that when the second-stage terminal of the keybox assembly 40 is activated, electric current of the battery 300 passes through the keybox assembly 40, the alarm bulb 20, and the L and B-terminals 12 and 14 of the generator 10, thus forming a closed circuit. The starter motor unit includes a grounded starter motor 210 and a magnetic switch 50. The magnet switch 50 includes three terminals: an ST-terminal 52 selectively connected to the keybox assembly 40, a B-terminal 54 connected to the storage battery 300 and an F-terminal 56 connected to the starter motor 210.

In accordance with the invention, a cut-off device is provided in the engine starting system for preventing electric current of the storage battery 300 from being applied to the magnetic switch 50 of the activated starter motor 210 thus positively preventing the activated starter motor 210 from being restarted carelessly. The cut-off device comprises a cut-off relay unit 30, which is connected to both the L-terminal 12 of the generator 10 and the alarm bulb 20. The cut-off relay unit 30 includes a movable terminal 32. The movable terminal 32 of the unit 30 normally connects the keybox assembly 40 to the ST-terminal 52 of the magnetic switch 50, thus applying the electric current of the battery 300 to the ST-terminal 52 and starting the starter motor 210 when the key is completely rotated to the third-stage terminal of the keybox assembly 40. The cut-off relay unit 30 also includes a desired voltage control resistor 34 and a relay Ry1, which selectively control the movable terminal 32 so as to separate the keybox assembly 40 from the ST terminal 52 when a high voltage is generated at the L-terminal 12 of the generator 10 after the starter motor 210 is started.

Figure 3:
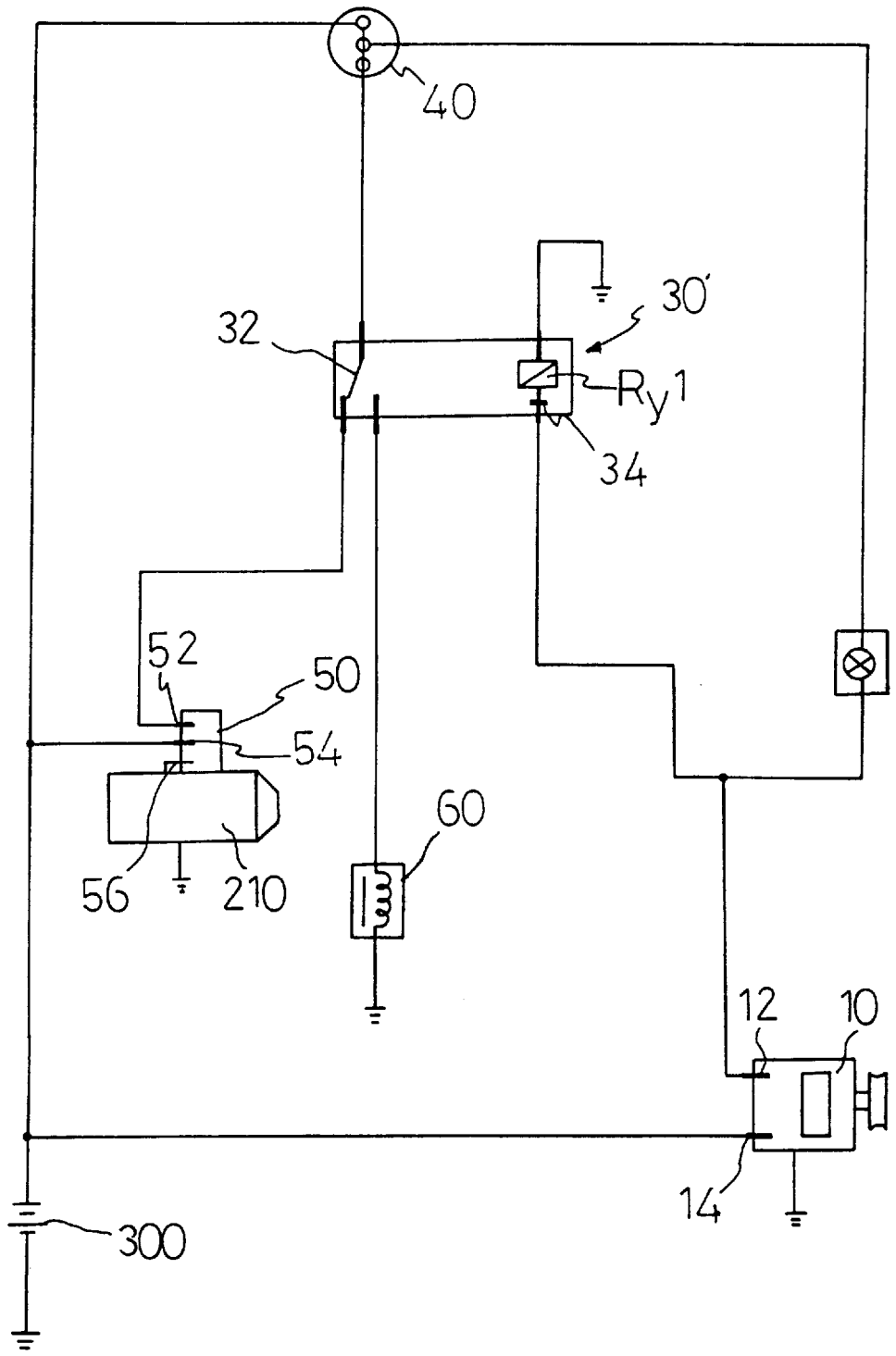
FIG. 3 is a circuit diagram of an engine starting system provided with a cut-off device according to the second embodiment of the present invention.

FIG. 3 is a circuit diagram of an engine starting system provided with a cut-off device according to the second embodiment of this invention. In the cut-off device according to the second embodiment, an alarm buzzer 60 is provided on the cut-off relay unit 30'. The alarm buzzer 60 selectively generates a voice alarm signal when a driver tries to carelessly restart the activated starter motor 210, thus making the driver stop the careless restarting of the motor 210.

Of course, it should be understood that a typical bell or alarm display in place of the above alarm buzzer 60 may be used as an alarm means without affecting the functioning of this invention.

The above engine starting system is operated as follows.

In order to start the engine, a driver inserts a key into the key hole of the keybox assembly 40, which is provided on the steering column, and primarily rotates the key to the second-stage terminal. The electric current of the battery 300 in the above state passes through the keybox assembly 40, the alarm bulb 20 and the L-terminal 12 of the generator 10 thus turning on the alarm bulb 20. Thereafter, when the key is further rotated in the same direction thus reaching the third-stage terminal of the keybox assembly 40, the electric current of the battery 300 is applied to the ST-terminal 52 of the magnetic switch 50 through both the keybox assembly 40 and the movable terminal 32 of the cut-off relay unit 30. In this case, the B-terminal 54 of the magnetic switch 50 is brought into intercontact with the F-terminal 56 of the switch 50 through an electromagnet (not shown) so that the starter motor 210 generates a large torque in a short time and starts the engine.

After the starter motor 210 starts the engine, the L-terminal 12 of the generator 10 generates a high voltage so that the alarm bulb 20 is turned off. In addition, both the desired voltage control resistor 34 and the relay Ry1 of the cut-off relay unit 30 control the movable terminal 32 in order to separate the ST-terminal 52 of the magnetic switch 50 from the keybox assembly 40. In the above state, the electric current of the battery 300 passes through the desired voltage control resistor 34 of the cut-off relay unit 30 so that the battery 300, keybox assembly 40, cut-off relay unit 30 and the generator 10 form a closed circuit. Since the movable terminal 32 of the cut-off relay unit 30 opens the ST-terminal 52 of the magnetic switch 50 as described above, the electric current of the battery 300 cannot be applied to the ST-terminal 52 of the magnetic switch 50 even when a driver carelessly rotates the key to the third-stage terminal of the keybox assembly 40 and tries to restart the activated starter motor 210. Therefore, the cut-off device of this invention effectively prevents the activated starter motor 210 from being restarted carelessly.

In the embodiment of FIG. 3, when a voltage of higher than the desired voltage is applied to the cut-off relay unit 30, the movable terminal 32 of the cut-off relay unit 30 opens the ST-terminal 52 of the magnetic switch 50 and is connected to the alarm buzzer 60 so that the battery 300, keybox assembly 40, the movable terminal 32 and the alarm bulb 60 form a closed circuit. When the key in the above state is carelessly rotated to the third-stage terminal of the keybox assembly 40, the electric current of the battery 300 is applied to the alarm buzzer 60 and turns on the buzzer 60 thus informing a driver of the careless restarting of the activated starter motor 210 and effectively preventing the activated starter motor 210 from being restarted carelessly.

As described above, the present invention provides a cut-off device for engine starting systems. The cut-off device of this invention has a cut-off relay unit on a motor drive circuit and prevents electric current of a storage battery from being applied to the magnetic switch of an activated starter motor, thus positively preventing the activated starter motor from being restarted carelessly. In addition, an alarm means such as a bell, alarm sound generator or alarm display may be provided on the cut-off relay unit. When a driver tries to restart an activated starter motor carelessly, the electric current of the battery is not applied to the starter motor but is applied to the alarm means, thus turning on the alarm means. The alarm means in the above state informs a driver of the careless restarting of the activated starter motor and makes the driver stop the careless restarting of the motor. Therefore, the cut-off device allows both an engine and the starter motor to be effectively used without being damaged within their expected life spans.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cut-off device for engine starting systems individually having an alarm bulb, a generator, a storage battery, a magnetic switch, a starter motor and a keybox assembly, comprising:

a cut-off relay unit connected to both an L-terminal of said generator and said alarm bulb and adapted for preventing electric current of said battery from being applied to the starter motor after the motor is activated, said cut-off relay unit including:

a movable terminal normally in a closed condition to connect said keybox assembly to an ST-terminal of said magnetic switch thereby closing a circuit for the starter motor but selectively separating the keybox assembly from the ST-terminal thereby opening the circuit for the starter motor after the motor is activated:

a desired voltage control resistor; and a relay adapted for controlling the movable terminal in cooperation with said resistor, thus selectively opening the circuit for the starter motor when a high voltage is generated from said L-terminal of the generator after the motor is activated.

2. The cut-off device according to claim 1, wherein an alarm display is provided on said cut-off relay unit.

3. The cut-off device for engine starting systems individually having an alarm bulb, a generator, a storage battery, a magnetic switch, a starter motor and a keybox assembly, comprising:

a cut-off relay unit connected to both an L-terminal of said generator and said alarm bulb and adapted for preventing electric current of said battery from being applied to the starter motor after the motor is activated, said cutoff relay unit including:

a movable terminal normally connecting said keybox assembly to an ST-terminal of said magnetic switch thereby closing a circuit for the starter motor but selectively separating the keybox assembly from the ST-terminal thereby opening the circuit for the starter motor after the motor is activated:

a desired voltage control resistor;

a relay adapted for controlling the movable terminal in cooperation with said resistor, thus selectively opening the circuit for the starter motor when a high voltage is generated from said L-terminal of the generator after the motor is activated; and an alarm buzzer.

4. The cut-off device for engine starting systems individually having an alarm bulb, a generator, a storage battery, a magnetic switch, a starter motor and a keybox assembly, comprising:

a cut-off relay unit connected to both an L-terminal of said generator and said alarm bulb and adapted for preventing electric current of said battery from being applied to the starter motor after the motor is activated, said cut-off relay unit including:

a movable terminal normally connecting said keybox assembly to an ST-terminal of said magnetic switch thereby closing a circuit for the starter motor but selectively separating the keybox assembly from the ST-terminal thereby opening the circuit for the starter motor after the motor is activated:

a desired voltage control resistor;

a relay adapted for controlling the movable terminal in cooperation with said resistor, thus selectively opening the circuit for the starter motor when a high voltage is generated from said L-terminal of the generator after the motor is activated; and an alarm sound generator.

* * * * *